US005139183A

United States Patent [19]

Buchser et al.

[11] Patent Number: 5,139,183

[45] Date of Patent: Aug. 18, 1992

[54] ICE CRUSHER ICE CHUTE DOOR

[75] Inventors: William J. Buchser, Marrs Township, Posey County; Carl R. Jarvis, Evansville, both of Ind.

[73] Assignee: Whirlpool Corporation, Benton Harbor, Mich.

[21] Appl. No.: 522,901

[22] Filed: May 14, 1990

[51] Int. Cl.[5] ..... B65D 47/00; B67D 3/00; B67D 5/06

[52] U.S. Cl. ..... 222/547; 222/556; 222/564

[58] Field of Search ..... 222/505-510, 222/146.6, 556, 547, 470, 472, 448, 535, 517, 481-487, 564; 221/154, 150 R, 247; 62/344, 377; 141/360-362

[56] References Cited

U.S. PATENT DOCUMENTS

| | | | |
|---|---|---|---|
| 1,412,329 | 4/1922 | Altenberg . | |
| 1,801,100 | 4/1931 | Meyer . | |
| 2,548,022 | 4/1951 | Hirsch . | |
| 3,020,979 | 2/1962 | Andersen | 222/517 X |
| 3,051,357 | 8/1962 | Elam | 222/564 X |
| 3,180,529 | 4/1965 | Buffington . | |
| 3,192,734 | 7/1965 | Swanson . | |
| 3,499,557 | 3/1970 | Walzel | 222/556 X |
| 3,561,231 | 2/1971 | Webb . | |
| 3,572,053 | 3/1971 | Jacobus et al. . | |
| 3,602,007 | 8/1971 | Drieci | 62/344 |
| 3,640,088 | 2/1972 | Jacobus et al. . | |
| 3,718,237 | 2/1973 | Gittelson et al. . | |
| 3,883,204 | 5/1975 | Prada et al. | 62/344 X |
| 3,942,334 | 3/1976 | Pink . | |
| 4,069,545 | 1/1978 | Holet et al. . | |
| 4,087,140 | 5/1978 | Linstromberg | 62/344 X |
| 4,089,436 | 5/1978 | Marks . | |
| 4,090,641 | 5/1978 | Lindenschmidt . | |
| 4,139,126 | 2/1979 | Krasner et al. | 222/146.6 |
| 4,209,999 | 7/1980 | Falk et al. | 62/344 |
| 4,220,266 | 9/1980 | Braden et al. | 62/344 X |
| 4,228,923 | 10/1980 | Barnard | 222/146.6 |
| 4,498,607 | 2/1985 | Jaschinski | 222/146.6 |
| 4,555,049 | 11/1985 | Mawby et al. . | |
| 4,802,609 | 2/1989 | Morse et al. | 222/556 X |
| 4,858,791 | 8/1989 | Coleman | 222/510 |
| 4,951,850 | 8/1990 | Clayton | 222/556 X |

*Primary Examiner*—Michael S. Huppert
*Assistant Examiner*—Kenneth DeRosa
*Attorney, Agent, or Firm*—Wood, Phillips, VanSanten, Hoffman & Ertel

[57] ABSTRACT

A closure is shown for use with an ice dispensing apparatus having an ice chute defining a front opening. The closure includes a door case having a front wall of a size and shape corresponding to the chute opening, a rearwardly turned perimeter wall connected to the front wall and having an outwardly turned flange, and a pair of baffles extending rearwardly from opposite sides of the flange. An insulation core is disposed within the perimeter wall rearwardly of the front wall. A gasket engages the chute incident to the closure being in the closed position. A rear wall is provided for substantially covering the chute opening incident to the closure being in the closed position. The baffles are operable to direct flow of ice pieces delivered through the opening when the closure is in the open position.

21 Claims, 5 Drawing Sheets

ICE CRUSHER ICE CHUTE DOOR

FIELD OF THE INVENTION

This invention relates to an ice dispensing apparatus and, more particularly, to an improved closure therefor.

BACKGROUND OF THE INVENTION

In one form of an ice making apparatus, an automatic apparatus is provided for forming ice bodies and periodically delivering the formed ice bodies into a subjacent container maintained within a freezer space of a refrigeration apparatus cabinet. In one conventional form, the ice bodies are removed from the container by a user grasping the ice bodies through an open top of the container and removing the desired quantity.

In another form of a refrigeration apparatus, a through-the-door ice dispenser is provided for automatically delivering a desired quantity of formed ice bodies from the container into a suitable receptacle, such as a glass or pitcher. Such an apparatus includes a conveying means for conveying ice bodies stored in the container to a discharge chute in the door. One example of such an automatic ice body dispenser is shown in Buchser U.S. Patent Application No. 459,651, filed Jan. 2, 1990, which is owned by the assignee of the present invention. As disclosed therein, the ice bodies are delivered from the container to a transfer mechanism by means of an auger which is rotated by a motor at the rear end of the auger. The forward end of the auger is connected to the transfer mechanism which transfers the ice bodies seriatim to the subjacent transfer chute leading to the dispensing area.

Associated with such a transfer mechanism is an ice crusher comprising a plurality of blades rotational with the auger and a solenoid actuated shutter. When the solenoid is energized, the shutter is opened and the ice cubes are transferred via the transfer mechanism directly to the chute. When the solenoid is deenergized, causing the shutter to remain closed, the ice bodies are maintained in the transfer mechanism and are crushed by the blades to deliver crushed ice through the chute.

A typical conventional through-the-door ice dispenser includes a front opening in the ice chute through which ice pieces are delivered in a dispensing operation. The ice pieces may comprise the fully formed ice bodies, or the crushed ice. Such an ice dispensing apparatus is shown in Marks U.S. Pat. No. 4,089,436, which is owned by the assignee of the present invention, and which comprises a closure mounted frontwardly of the opening and being biased to a closed position wherein the closure effectively blocks the opening. An actuator is mounted adjacent the closure for moving the closure to an open position to permit free delivery of ice pieces through the opening as an incident of the actuator being moved from a released position to an actuated position.

Such a closure comprises an insulated well having an outer gasket for sealing engagement with the chute. The surface which engages the chute is generally planar. When the closure is in the open position, the ice pieces freely pass to the subjacent container. If the ice pieces are in the form of ice bodies, then operation is generally satisfactory. However, it has been found that when dispensing crushed ice, the chute opening is fully exposed so that there is no control of flying ice particles through the opening. Indeed, such ice particles are frequently known to scatter in unpredictable directions and may end up on the floor or other places not considered desirable.

The present invention is directed to overcoming one or more of the problems as set forth above.

SUMMARY OF THE INVENTION

There is disclosed herein, in accordance with the present invention, an ice dispenser closure provided with a baffle with acts to direct flow of ice pieces delivered through a chute opening.

Broadly, there is disclosed herein an ice dispensing apparatus having an ice chute defining a front opening through which ice pieces are delivered in a dispensing operation. An improvement therein comprises a closure mounted frontwardly of the opening and being biased to a closed position wherein the closure effectively blocks the opening. An actuator is mounted adjacent the closure and includes means for moving the closure to an open position to permit free delivery of ice pieces through the opening as an incident of the actuator being moved from a released position to an actuated position. A baffle extends rearwardly from the closure to direct flow of ice pieces delivered through the opening when the closure is in the open position.

It is a feature of the invention that the baffle comprises a pair of side walls extending rearwardly from opposite sides of the closure.

It is another feature of the invention that the baffle is integral with the closure.

In accordance with another aspect of the invention, the improvement comprises a gasket secured to a rear side of the closure for sealing engagement with the chute when the closure is in the closed position.

It is an additional feature of the invention that the closure further comprises a rear wall and the gasket includes an exposed portion surrounding an outer edge of the rear wall.

There is disclosed herein in accordance with a further aspect of the invention an improvement in an ice dispensing apparatus having an ice chute comprising a generally tubularlike wall portion defining a front opening through which ice pieces are delivered in a dispensing operation. The improvement comprises an ice chute closure including a door case having a front well of a size and shape corresponding to the chute opening, the well being connected to an outwardly turned perimeter flange having a pair of side baffles extending rearwardly from opposite sides of the flange. The flange supports a gasket. Means are provided for mounting the closure frontwardly of the opening and being biased to a closed position wherein the closure effectively blocks the opening with the gasket sealing against the wall portion and the baffles being disposed outwardly of the wall portion. An actuator is mounted adjacent the closure and includes means for moving the closure to an open position to permit free delivery of ice pieces through the opening as an incident of the actuator being moved from a released position to an actuated position, the baffles being operable to direct flow of ice pieces delivered through the opening when the closure is in the open position.

In accordance with one embodiment to the invention, the gasket comprises a foam pad having its outer edges secured to the flange.

In accordance with the invention, there is also provided an impact shield secured to a rear surface of the pad where only a peripheral edge portion of the pad is exposed.

In accordance with an alternative embodiment of the invention, there is disclosed herein a rear wall secured to the well and the gasket comprises a gasket material secured along an outer edge of the rear wall.

It is a feature of the invention that a core of insulation is disposed in the well.

More specifically, there is disclosed herein a closure for use with an ice dispensing apparatus having an ice chute defining a front opening. The closure includes a door case having a front wall of a size and shape corresponding to the chute opening, a rearwardly turned perimeter wall connected to the front wall and having an outwardly turned flange, and a pair of baffles extending rearwardly from opposite sides of the flange. An insulation core is disposed within the perimeter wall rearwardly of the front wall. A gasket engages the chute incident to the closure being in the closed position. A rear wall is provided for substantially covering the chute opening incident to the closure being in the closed position. Means are provided for adhering the gasket and the rear wall in assembled relation with the flange, the baffles being operable to direct flow of ice pieces delivered through the opening when the closure is in the open position.

Further features and advantages of the invention will readily be apparent from the specification and from the drawings.

DETAILED DESCRIPTION OF THE INVENTION

Figure 1:
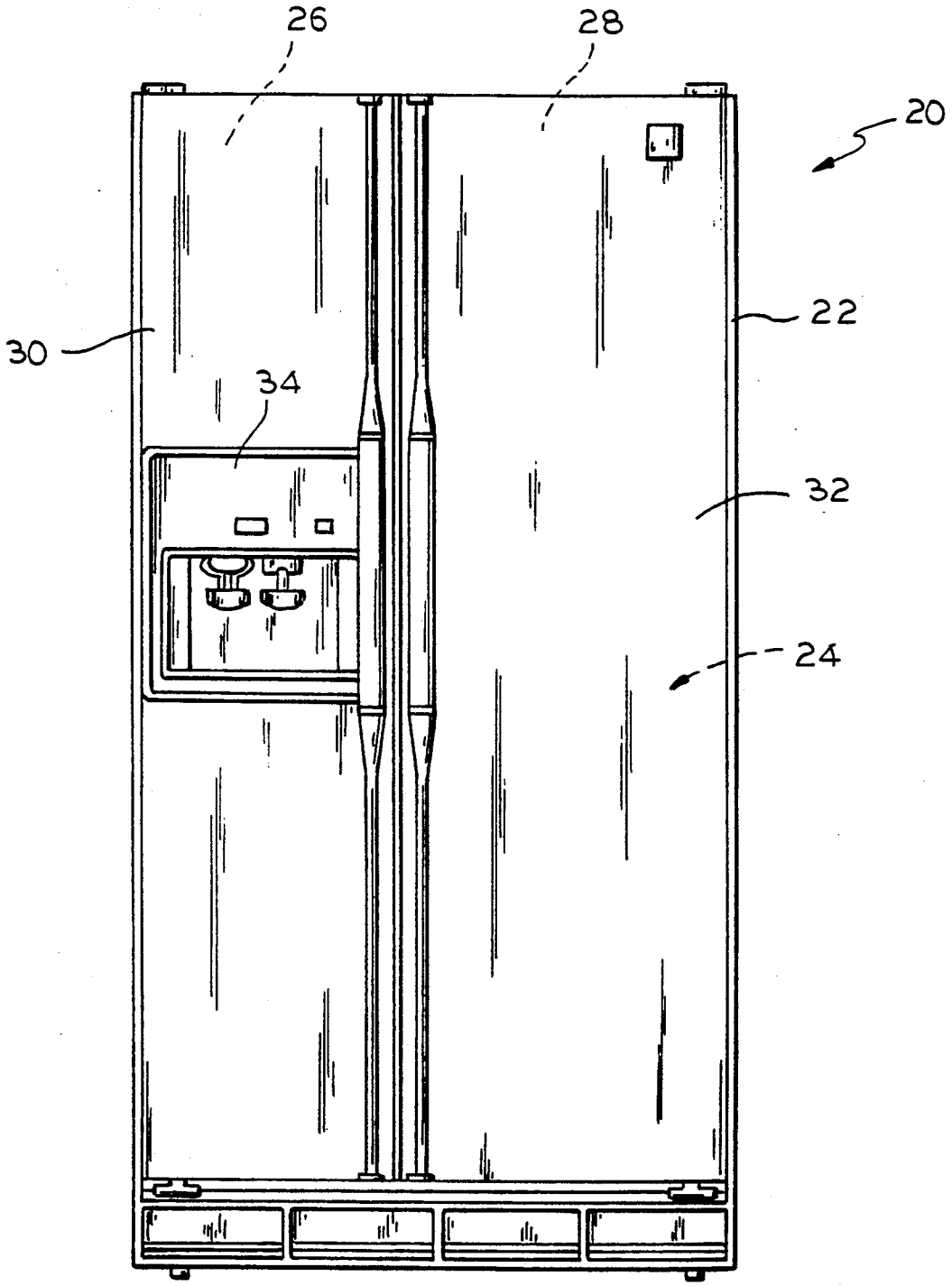
FIG. 1 is a front elevation view of a refrigeration apparatus including an ice dispenser closure according to the invention.

With reference to FIG. 1, a refrigeration apparatus 20, comprising a side-by-side refrigerator/freezer, includes a cabinet 22 having a storage space 24. Particularly, the storage space 24 comprises a below-freezing, or freezer, compartment 26, and an above-freezing, or fresh food, refrigerated compartment 28. Access to the compartments 26 and 28 is had through respective freezer and refrigerator doors 30 and 32 hingedly mounted to the cabinet 22, as is well known.

Figure 2:
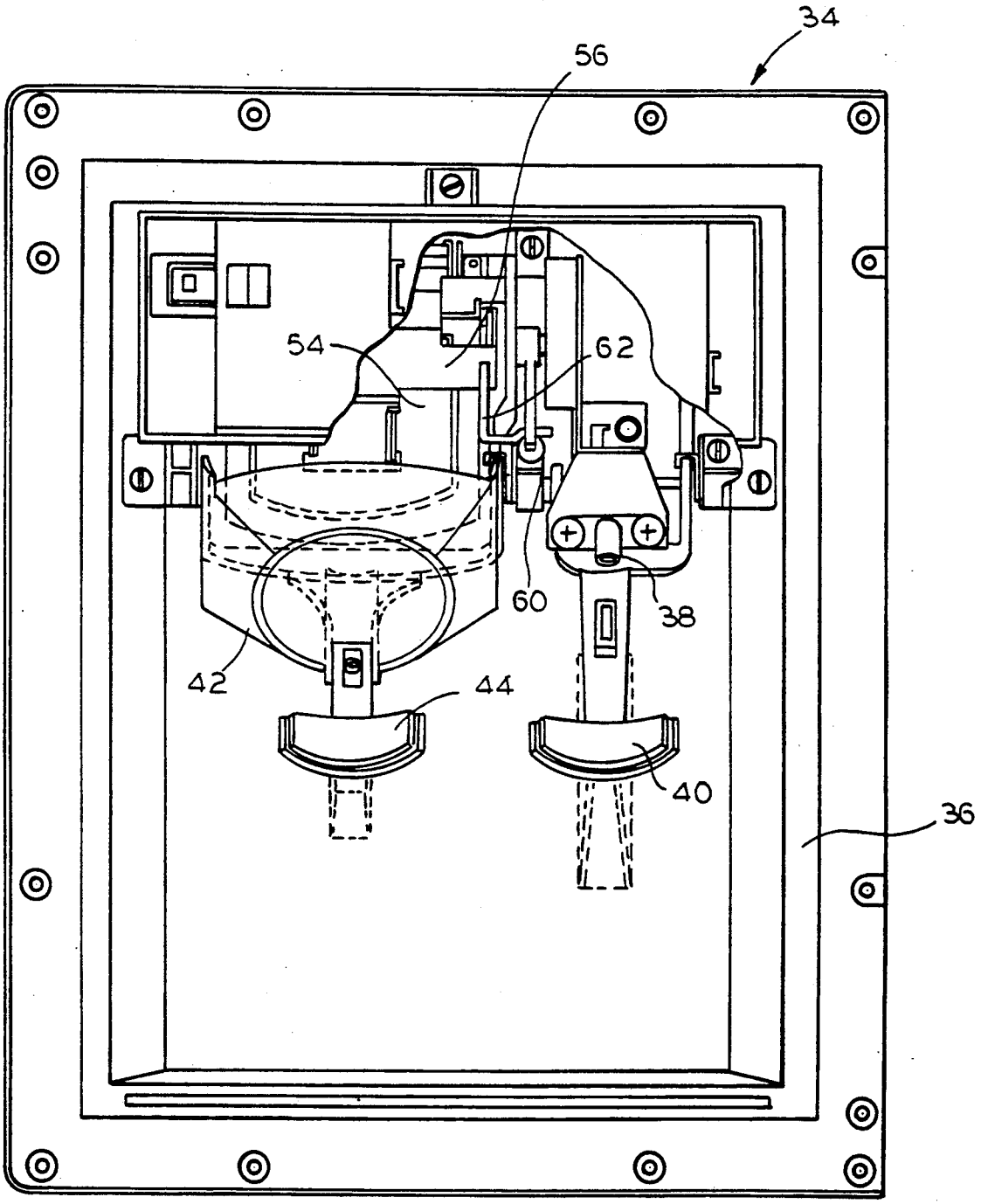
FIG. 2 is a front elevation view of a through-the-door ice dispensing housing of FIG. 1 with a cover plate removed.

The freezer door 30 is provided with a through-thedoor ice and water dispenser 34. The dispenser 34 is contained within a housing 36, see FIG. 2, suitably mounted in the freezer door 30. The dispenser 34 includes a water spigot 38 through which water is automatically transferred to a receptacle position therebelow actuating a water dispenser lever 40, and an ice passage 42 through which ice pieces may be automatically transferred upon actuation of an ice dispenser lever 44. In the illustrated embodiment, the ice pieces may be fully formed ice bodies or crushed ice.

Although not shown, the freezer compartment 26 houses a conventional ice making apparatus which delivers ice pieces to a downwardly, forwardly inclined delivery chute 46 in the door 30. Particularly, the chute 46 comprises a generally tubularlike wall portion 48 of a rear wall 50 of the dispenser housing 36 and defining a front opening 52 through which ice pieces are delivered in a dispensing operation. The wall-portion 48 is configured to be generally rectangular, except that the bottom wall thereof is curved to facilitate transfer of ice pieces, as is well known.

A closure 54 is mounted frontwardly of the opening 52. Specifically, a mounting structure 56 is pivotally mounted to the housing 36 as at a pivot link 58, and the mounting structure 56, see also FIG. 5, biases the closure 54 to a closed position, illustrated in FIG. 3, effectively blocking the opening 52. As illustrated generally in FIG. 2, the ice dispenser lever 44 is mounted in the housing 36 adjacent the closure 54 and includes an actuator arm 60 for engaging a connecting rod 62 extending sidewardly from the mounting structure 56. As such, movement of the dispenser lever 44 from a released position to an actuated position cause the closure 54 to move to the open position, illustrated in FIG. 4, to permit free delivery of ice pieces through the opening 52.

The mounting structure 56 and its operation as disclosed herein are for illustration only. For a more complete understanding relative to the operation of the same, reference may be had to Marks U.S. Pat. No. 4,089,436, owned by the assignee hereof. In fact, the particular mounting structure and actuating mechanism may take many known forms and the embodiment disclosed herein is merely a illustrative of one such known form.

In accordance with the invention, the closure 54 provides for the control of flying ice particles through the opening 52. Particularly, when the ice dispensing apparatus is used to dispense crushed ice, it is desirable to control ice particles to prevent same from scattering in unpredictable directions and ending up on the floor or other places which are not considered desirable.

With reference to FIGS. 6–9, the closure 54 is illustrated in detail. The closure 54 includes a door case 64 having a front wall 66 of a size and shape corresponding to the chute opening 52. A rearwardly turned perimeter wall 68 is connected to the front wall 66 to provide a well 70. A perimeter flange 72 is connected to and extends outwardly from the perimeter wall 68. A pair of baffle walls 74 are connected to and extend rearwardly from opposite sides of the flange 72. A pair of locking tabs 76 extend frontwardly from the front wall 66 and are used for mounting the closure 54 to the locking structure 56, as disclosed in FIG. 5. A protrusion 78, also on the front wall 66 between the locking tabs 76, rides on the locking structure 56 to allow for limited movement between the closure 54 and mounting structure 56 to insure a proper seal when the closure 54 is in the closed position.

In the illustrated embodiment, the door case 64 is of integral, molded construction, and may be of, for example, A.B.S plastic.

In order to minimize heat transfer between the freezer compartment 26 and the outside, the well 70 is filled with a core 80 of insulation. The core 80 may comprise, for example, closed-cell polyethylene foam. The core 80 is flush mounted with the flange 72 and supports a foam pad 82. Particularly, the foam pad 82 is secured using a suitable adhesive to both the flange 72 and the core 80. The foam pad 82 may be, for example, closed-cell polyethylene foam. The pad 82 is slightly larger than the chute wall portion 48 so that when the closure 54 is in the closed position, see FIG. 4, the outer edge of the pad 82 engages the same.

An impact shield 84 is secured to the rear surface of the pad 82. Particularly, the impact shield 84 may comprise, for example, a mylar polyester clear film. The shield 84 may be sealed using pressure sensitive adhesive to the pad 82. The impact shield 84 is of a size corresponding to that of the gasket pad 82, but is of a slightly smaller size so that a peripheral, outer edge gasket portion 86 of the pad 82 is exposed.

Figure 3:
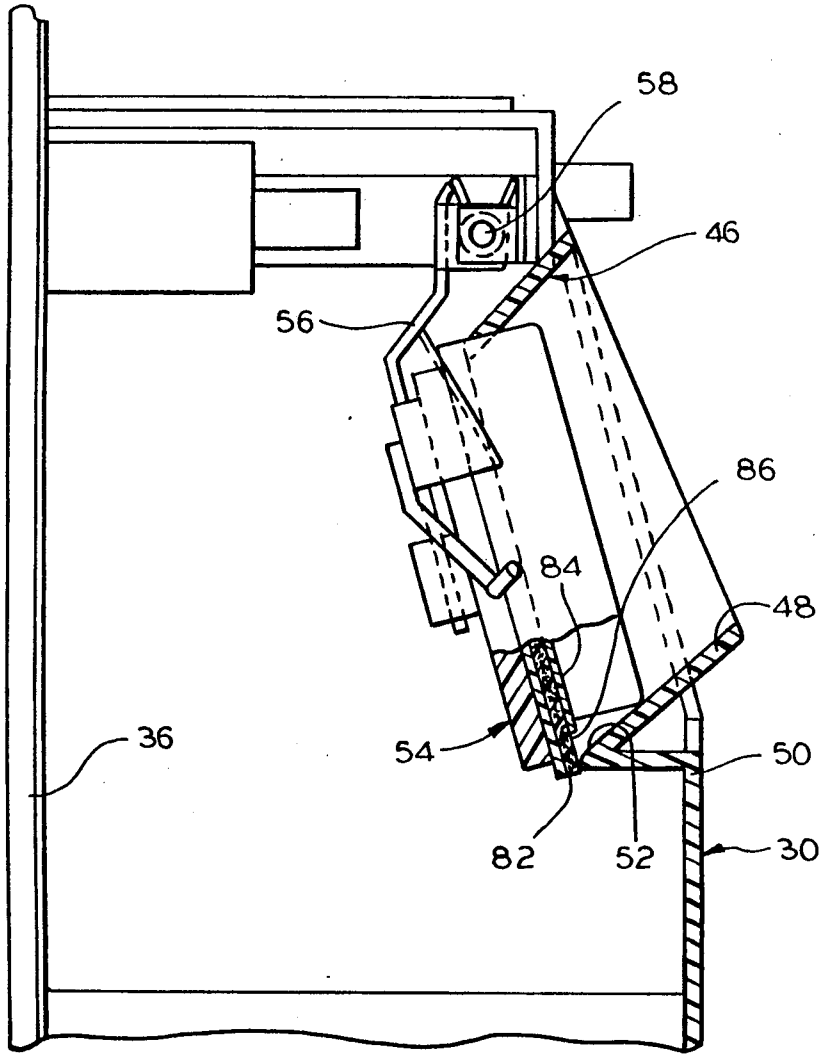
FIG. 3 is a partial sectional view, with parts removed for clarity, taken along the line 3—3 of FIG. 2 specifically illustrating a closure in the closed position.

Thus, when the closure 54 is in a closed position, as illustrated in FIG. 3, the gasket outer edge portion 86 engages the outer edge of the chute wall 48 to provide a seal and prevent flow of air between the freezer compartment and ambient. Further, the impact shield 84 minimizes the amount of ice which comes into direct contact with the pad 82 in order to prevent freeze up thereof which would diminish the sealing capability of the pad 82.

Figure 4:
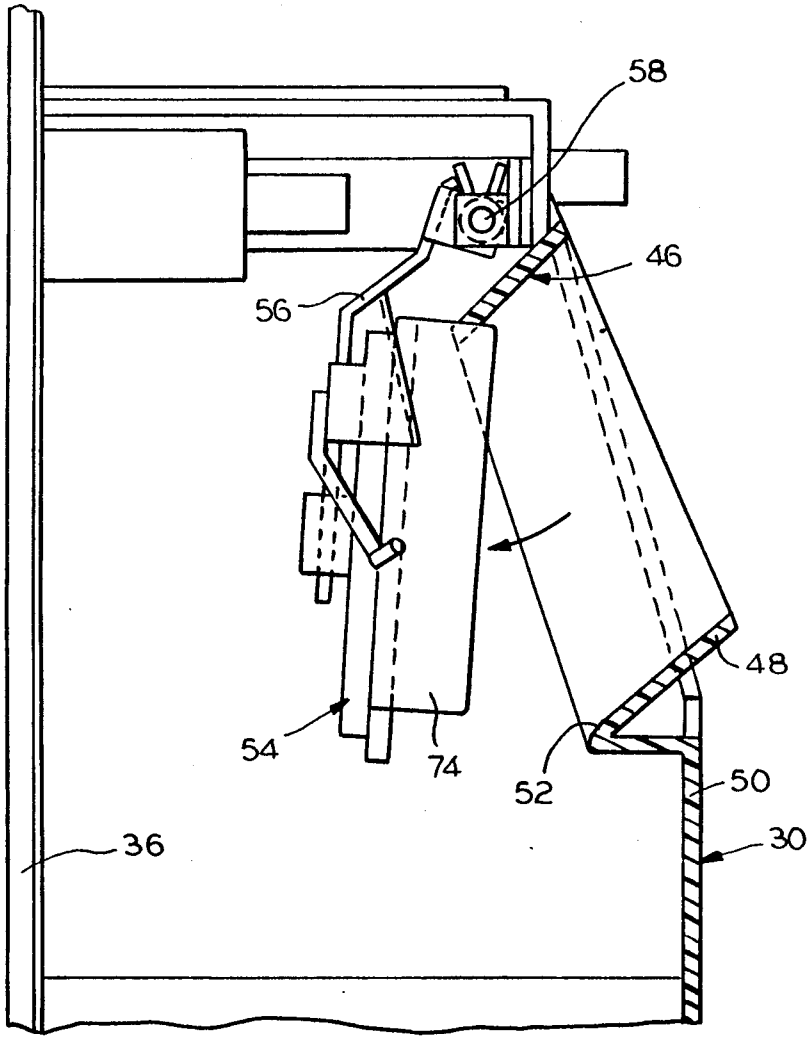
FIG. 4 is a partial section view, similar to that of FIG. 3, specifically illustrating the closure in the open position.
Figure 5:
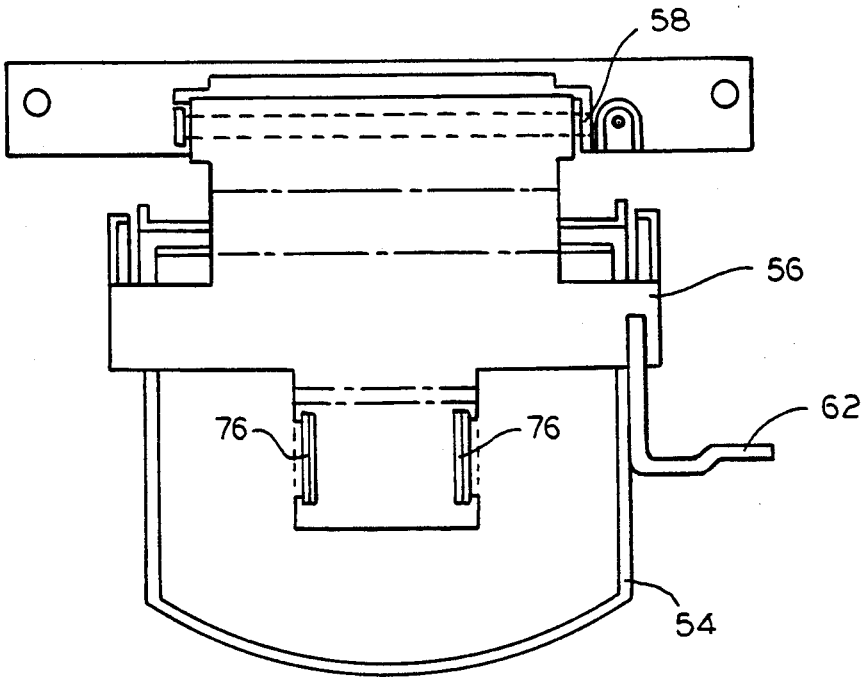
FIG. 5 is a front elevation view of the closure and mounting means therefor of FIG. 2.
Figure 6:
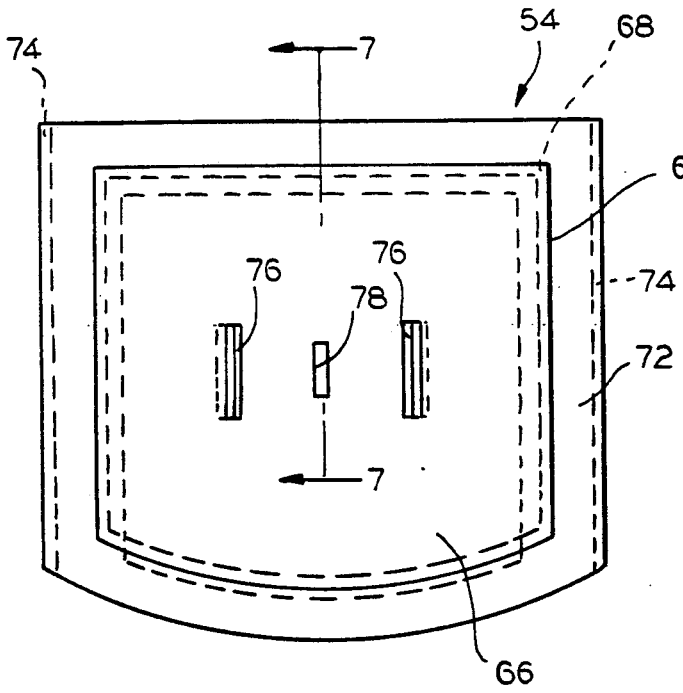
FIG. 6 is a front elevation view of the closure of FIG. 2.
Figure 7:
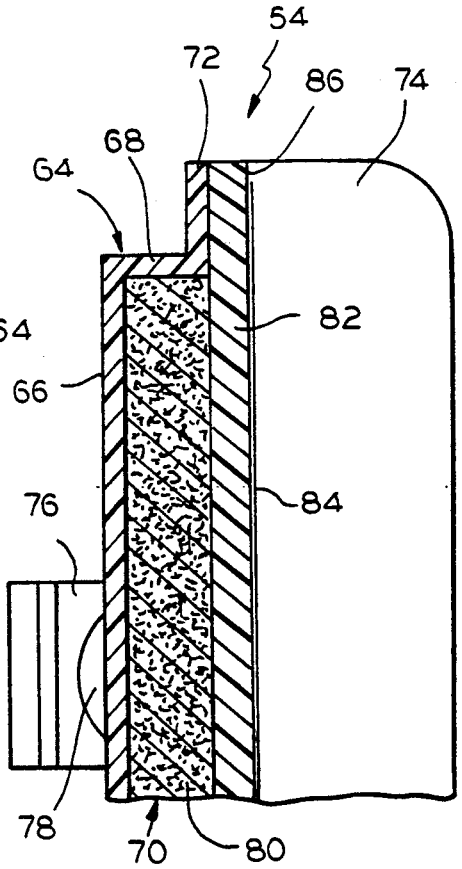
FIG. 7 is a sectional view taken along the line 7—7 of FIG. 6.
Figure 8:
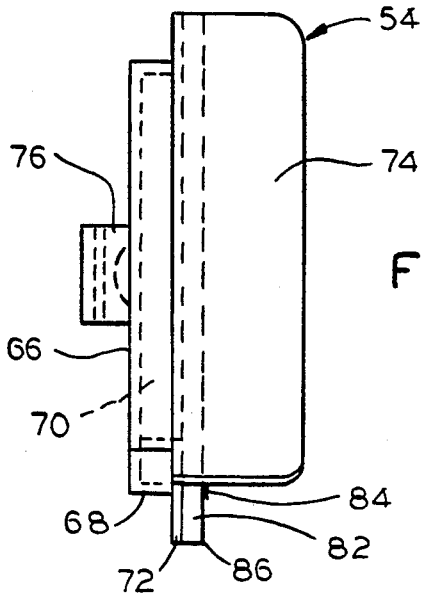
FIG. 8 is a side view of the closure of FIG. 6.
Figure 9:
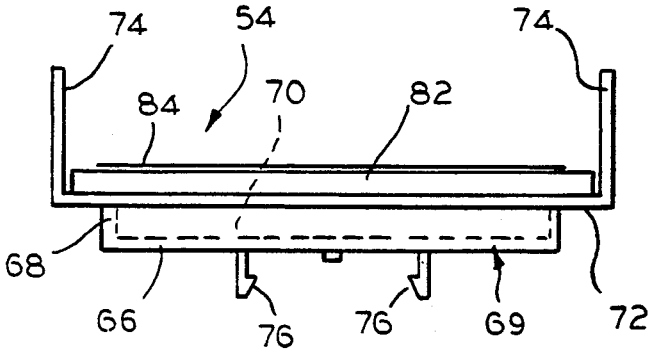
FIG. 9 is a plan view of the closure of FIG. 6.

When the closure 54 is in the closed position, see FIG. 3, the baffle walls 74 are disposed outwardly of the ice chute wall portion 48. When the closure 54 is moved to the open position, as illustrated in FIG. 4, a free delivery of ice pieces is permitted through the opening 52. At the same time, the baffle walls 74 which are positioned on opposite sides of the chute wall portion 48 direct the flow of ice pieces delivered through the opening 52. Specifically, the baffle walls 74 prevent the scattering of ice particles in unpredictable directions by more particularly directing any such ice particles in a downward direction where they will be directed through the subjacent passage 42, see FIG. 2, into a suitable container or the like.

Although the door case 64 is illustrated with the baffle walls 74 located along the opposite side walls, additional baffle walls, or partial walls, could be provided along a lower portion of the door case to further control delivery of ice pieces.

Figure 10:
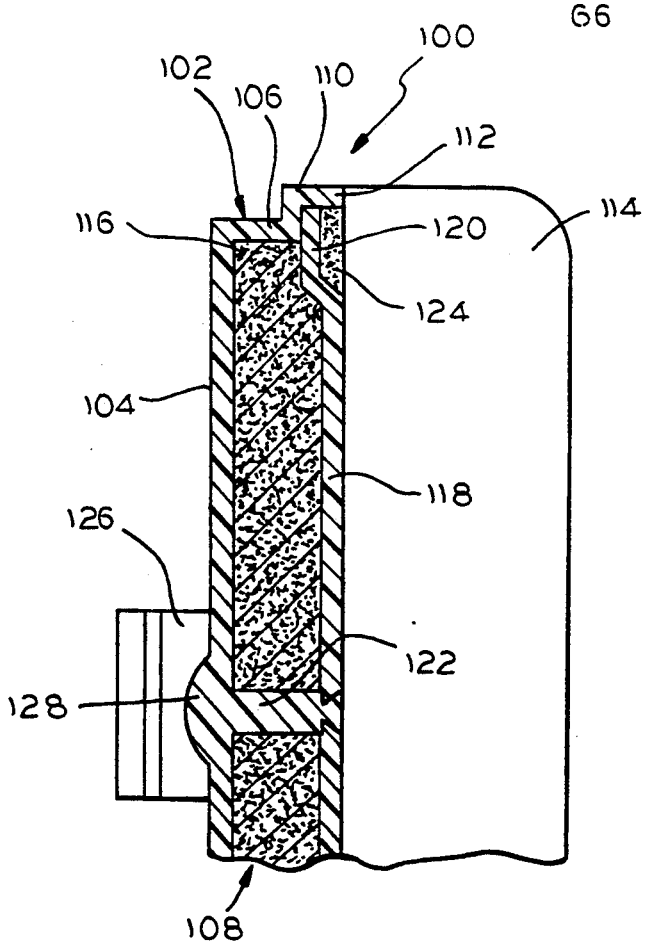
FIG. 10 is a sectional view, similar to the view of FIG. 7, for a closure according to an alternative embodiment of the invention.

With reference to FIG. 10, there is illustrated a closure 100 according to an alternative embodiment to the invention. The closure 100 comprises a door case 102. The door case 102 includes a front wall 104 connected to a rearwardly turned perimeter wall 106 to form a well 108. An outwardly turned flange 110 is connected to the perimeter wall 102 and is further connected to a rearwardly turned outer wall 112 along the top and bottom thereof, and opposite baffle side walls 114 along each side. Particularly, the door case 102 is of molded, integral construction and may be of, for example, polypropylene.

The well 108 is filled with a core 116 of insulation which may be, for example, urethane foam. The well 108 with the core 116 therein, is covered by a rear wall 118 having an outer perimeter well portion 120. The rear wall 118 may be formed of a similar material as the door case 102 and is staked to the door case 102 using a suitable center stake 122. The outer edge of the rear wall 118 may be further secured to the door case 102 using stakes or an adhesive, or the like.

Disposed within the outer perimeter well portion 120 is a gasket material 124. Preferably, the gasket material 124 is integrally molded with the rear wall 118 to effect a proper seal therebetween. The gasket material 124 may be, for example, a synthetic rubber which is homogeneous with polypropylene.

The door case 102 is further provided with mounting tabs 126 and a projection 128, similar to the corresponding elements 76 and 78 of the closure 54, for mounting to the mounting structure 56. The closure 100 operates similar to the closure 54 with the gasket material 124 providing a proper seal, the exposed portion of the rear wall 118 performing a function similar to the impact shield 84, and the baffle walls 114 directing flow of ice pieces through the opening 52 when the closure 100 is in the open position.

Thus, there is disclosed herein, in accordance with the invention, a closure for use with an ice dispensing apparatus which includes baffle walls for directing flow of ice pieces delivered through an ice chute opening when the closure is in the open position.

The disclosed embodiments of the invention are illustrative of the broad inventive concepts comprehended hereby.

I claim:

1. In an ice dispensing apparatus having an ice chute defining a front opening through which ice pieces are delivered in a dispensing operation, the improvement comprising:

a closure mounted frontwardly of said opening and being biased to a closed position wherein said closure effectively blocks said opening, said closure comprising a rear wall of a size slightly smaller than said opening and surrounded by a peripheral gasket so that in said closed position said gasket is in sealing engagement with said chute and said rear wall overlies said opening; and an actuator mounted adjacent said closure and including means for moving said closure to an open position to permit free delivery of ice pieces through said opening as an incident of said actuator being moved from a released position to an actuated position.

2. In an ice dispensing apparatus having an ice chute defining a front opening through which ice pieces are delivered in a dispensing operation, the improvement comprising:

a closure mounted frontwardly of said opening and being biased to a closed position wherein said closure effectively blocks said opening, said closure comprising a rear wall of a size slightly smaller than said opening and surrounded by a peripheral gasket so that in said closed position said gasket is in sealing engagement with said chute and said rear wall overlies said opening;

an actuator mounted adjacent said closure and including means for moving said closure to an open position to permit free delivery of ice pieces through said opening as an incident of said actuator being moved form a released position to an actuated position; and a baffle extending rearwardly from said closure to direct flow of ice pieces delivered through said opening when said closure is in the open position.

3. The improvement of claim 2 wherein said baffle comprises a pair of side walls extending rearwardly from opposite sides of said closure.

4. The improvement of claim 2 wherein said baffle is integral with said closure.

5. In an ice dispensing apparatus having an ice chute comprising a generally tubular-like wall portion defining a front opening through which ice pieces are delivered in a dispensing operation, the improvement comprising:

an ice chute closure including a door case having a front well of a size and shape corresponding to said chute opening, said well being connected to an outwardly turned perimeter flange having a pair of side baffles extending rearwardly from opposite sides of said flange, said flange supporting a rear wall of a size slightly smaller than said chute opening and surrounded by a peripheral gasket;

means for mounting said closure frontwardly of said opening and being biased to a closed position wherein said closure effectively blocks said opening with said gasket sealing against said wall portion and said rear wall overlying said opening and said baffles being disposed outwardly of said wall portion; and an actuator mounted adjacent said closure and including means for moving said closure to an open position to permit free deliver of ice pieces through said opening as an incident of said actuator being moved from a released position to an actuated position, said baffles being operable to direct flow of ice pieces delivered through said opening when said closure is in the open position.

6. The improvement of claim 5 wherein said baffles are integral with said flange and said door case.

7. The improvement of claim 5 wherein said gasket comprises a foam pad having its outer edges secured to said flange.

8. The improvement of claim 7 wherein said rear wall comprises an impact shield secured to a rear surface of said pad wherein only a peripheral edge portion of said gasket is exposed.

9. The improvement of claim 5 further comprising a core of insulation disposed in said well.

10. A closure of ruse with an ice dispensing apparatus having an ice chute defining a front opening through which ice pieces are delivered in a dispensing operation, the closure being mounted frontwardly of the opening and being biased to a closed position wherein the closure effectively blocks the opening, and an actuator mounted adjacent the closure and including means for moving the closure to an open position to permit free delivery of ice pieces through the opening as an incident of the actuator being moved from a released position to an actuated position, the closure comprising:

a door case having a front wall of a size and shape corresponding to the chute opening, a rearwardly turned perimeter wall connected to said front wall and having an outwardly turned flange, and a pair of baffles extending rearwardly from opposite sides of said flange;

an insulation core disposed within said perimeter wall rearwardly of said front wall;

a rear wall for substantially covering said chute opening incident to the closure being in the closed position;

a gasket peripherally surrounding said rear wall for engaging the ice chute incident to the closure being in the closed position; and means adhering said gasket and said rear wall in assembled relation with said flange, said baffles being operable to direct flow of ice pieces delivered through said opening when said closure is in the open position.

11. The closure of claim 10 wherein said baffles are integral with said flange and said door case.

12. The closure of claim 10 wherein said gasket comprises a foam pad having its outer edges secured to said flange.

13. The closure of claim 12 wherein said rear wall comprises an impact shield secured to a rear surface of said pad wherein only a peripheral edge portion of said gasket is exposed.

14. The closure of claim 10 further comprising a body of insulation disposed in said well.

15. The closure of claim 10 wherein said gasket comprises a gasket material secured along an outer edge of said rear wall.

16. The closure of claim 15 further comprising a body of insulation disposed between said well and said rear wall.

17. In an ice dispensing apparatus having an ice chute comprising a generally tubular-like wall portion defining a front opening through which ice pieces are delivered in a dispensing operation, the improvement comprising:

an ice chute closure including a door case having a front well of a size and shape corresponding to said chute opening, said well being connected to an outwardly turned perimeter flange, said flange supporting a rear wall of a size slightly smaller than said chute opening and surrounded by a peripheral gasket;

means for mounting said closure frontwardly of said opening and being biased to a closed position wherein said closure effectively blocks said opening with said gasket sealing against said wall portion and said rear wall overlying said opening; and an actuator mounted adjacent said closure and including means for moving said closure to an open position to permit free delivery of ice pieces through said opening as an incident of said actuator being moved from a released position to an actuated position.

18. The improvement of claim 17 wherein said gasket comprises a foam pad having its outer edges secured to said flange.

19. The improvement of claim 18 wherein said rear wall comprises an impact shield secured to a rear surface of said pad wherein only a peripheral edge portion of said gasket is exposed.

20. The improvement of claim 17 further comprising a core of insulation disposed in said well.

21. The closure of claim 17 wherein said gasket comprises a gasket material secured along an outer edge of said rear wall.

* * * * *